US007568586B2

(12) United States Patent
Walters, Jr.

(10) Patent No.: US 7,568,586 B2
(45) **Date of Patent: *Aug. 4, 2009**

(54) EASY OPEN CONTAINER CLOSURE

(76) Inventor: Lawrence S. Walters, Jr., 505 Amity Rd., Woodbridge, CT (US) 06525

( * ) Notice: Subject to any disclaimer, the term of this patent is extended or adjusted under 35 U.S.C. 154(b) by 603 days.

This patent is subject to a terminal disclaimer.

(21) Appl. No.: 11/049,821

(22) Filed: Feb. 3, 2005

(65) Prior Publication Data

US 2005/0189313 A1 Sep. 1, 2005

Related U.S. Application Data

(63) Continuation-in-part of application No. 09/579,050, filed on May 26, 2000, now Pat. No. 6,860,397.

(60) Provisional application No. 60/136,332, filed on May 26, 1999.

(51) Int. Cl.
*B65D 41/16* (2006.01)
*B65D 41/46* (2006.01)
*B65D 41/18* (2006.01)

(52) U.S. Cl. ..... 215/305; 215/295; 215/317; 215/901; 220/281; 220/793

(58) Field of Classification Search ..... 215/305, 215/304, 301, 901, 230, 317, 324, 295; 220/282, 220/281, 784, 793
See application file for complete search history.

(56) References Cited

U.S. PATENT DOCUMENTS 873,867 A * 12/1907 Kirkegaard ..... 215/305
1,838,534 A * 12/1931 Lee ..... 215/304
1,894,504 A * 1/1933 Wempe ..... 215/305
2,254,826 A * 9/1941 Slovak et al. ..... 215/304
2,750,062 A 6/1956 Satz
2,778,520 A 1/1957 Hydr, Jr.
3,204,813 A 9/1965 McCuskey et al.
3,300,073 A * 1/1967 Erwin ..... 215/253
3,425,580 A 2/1969 Brockhage
3,603,473 A 9/1971 Winberg
3,794,207 A 2/1974 Hunt
3,927,796 A 12/1975 Whitehouse
RE28,862 E 6/1976 Siemonsen et al.

(Continued)

*Primary Examiner*—Anthony D Stashick
*Assistant Examiner*—Niki M Eloshway
(74) *Attorney, Agent, or Firm*—Ohlandt, Greeley, Ruggiero & Perle, LLP

(57) ABSTRACT

The present invention is directed to an improved container closure or lever cap comprising one or more of the following features: (i) an improved interface on the interior surface of the closure that consists of strategically positioned locking lugs to securely affix the closure onto a container, (ii) a repositioned lever handle and fulcrum to optimize function and mechanical advantage, (iii) a retro-fit sleeve for an incompatible container, which on the inner surface is fashioned to interface with twist necks bottles, or other closure designs and mechanisms incompatible with the interior fitting of the lever cap, and which on the exterior is fashioned to receive the interior fitting of the lever cap, (iv) a tamper-evident safety indicator, (v) a specialized vertical sloping sidewall at the container's distal end near the opening to improve the closure's vertical lift during operation, (vi) a child safety design and mechanism that requires two functions to unlock the lever and position it for normal operation, and (vii) certain ergonomic, aesthetic, and customizable features that improve its function and consumer appeal.

30 Claims, 12 Drawing Sheets

U.S. PATENT DOCUMENTS 4,326,649 A 4/1982 Marino et al.
4,409,864 A 10/1983 Gaskins
4,431,111 A 2/1984 Prohaska
4,433,597 A 2/1984 Rowland
4,564,116 A 1/1986 Prohaska
4,633,740 A 1/1987 Jacobs
4,653,354 A 3/1987 Clapp
4,679,697 A 7/1987 Allaire
4,702,130 A 10/1987 Davis
4,703,867 A 11/1987 Schoenhard
4,756,442 A 7/1988 Halm et al.
4,768,667 A * 9/1988 Magnusson ..... 215/255
4,852,432 A 8/1989 Rodriquez Salcedo
4,864,898 A 9/1989 Tricinella
4,949,600 A 8/1990 Tricinella
4,951,829 A 8/1990 Hsu
4,967,622 A 11/1990 Phillips
4,976,172 A 12/1990 Thomas et al.
5,251,770 A 10/1993 Bartley et al.
5,265,746 A 11/1993 Lee
5,265,748 A 11/1993 Furukawa
5,267,494 A 12/1993 Waluda
5,722,568 A 3/1998 Smith
5,884,788 A * 3/1999 Wilde ..... 215/230
6,299,005 B1 10/2001 Higgins
6,860,397 B1 * 3/2005 Walters, Jr. ..... 215/305

* cited by examiner

EASY OPEN CONTAINER CLOSURE

CROSS-REFERENCE TO RELATED APPLICATIONS

This application claims priority from U.S. patent application Ser. No. 09/579,050, filed on May 26, 2000, now U.S. Pat. No. 6,860,397 which was based on U.S. Provisional Patent Application No. 60/136,332, filed on May 26, 1999.

BACKGROUND OF THE INVENTION

1. Field of the Invention

The present invention is directed to an improved container closure, and, in particular, a lever cap.

2. Description of the Related Art

Although the term "bottle" is often used in this patent and in the prior U.S. patent application Ser. No. 09/579,050, any container is intended, and may include, without limitation, bottles, jars, canisters, pill and medicine bottles, jugs, cans, drums, and all other containers of various shapes, sizes, and capacities on which the present invention may be used, provided such container's opening can be produced, fashioned, or retro-fitted to received the lever cap; use of the word "container" or any other vessel mentioned above shall be deemed to incorporate all such terms. Furthermore, the present invention may also be referred to herein by the use of different terms, including, "closure", "container closure", "cap", "lever cap", "covering", or "lid".

BACKGROUND TO THE INVENTION

Container closures, such as the early bottle crown caps, typically consisted of a circular piece of die stamped steel or other suitable metal that was crimped over the top lip or bead of a bottle. This device provided a secure and reliable closure, but required a tool to remove it. Typically, the cap was removed with an opener that would engage a portion of the lower edge of the bottle cap, and with sufficient force, outwardly deform a portion of the metal crimps causing the cap to be lifted upward and removed. This movement had the effect of distorting the original crimping structure at the bottom edge of the cap, and often permanently creased the top of the cap into a shape that prevented it from being effectively reused.

Removing a crown cap from a bottle also required two hands, one to hold the bottle and the other to manipulate the opener. In certain circumstances such as commercial applications, the bottle opener was often permanently affixed to a wall or the dispensing machine, thereby permitting the use of only one hand, but still, such a tool was needed. Over the years numerous patents were filed on various bottle opening tools. One common feature of nearly all of these bottle cap removers was the similarity in which they operated. Whether they employed a single handle with a hooked edge for engaging the bottom of the bottle cap, or a more elaborate structure, each bottle cap remover was a separate device that was brought in contact with the cap to pry the cap off in an outward and upward direction. Once the cap was removed, it was usually deformed and unsuitable for reuse and had to be discarded.

A more recent improvement to the crown cap was the twist off bottle cap, which is commonly used for soda bottles and other containers that require a secure seal to prevent the container's pressurized contents from escaping. This cap has an interior threaded structure compatible with the bottle's exterior threaded structure near the bottle's opening. The twist off cap is designed to be reusable and provides a tight seal to secure the contents within the container. Although it does not require a separate tool to remove it, in practice, it is often quite difficult to initially release, because it is tightly affixed to the bottle, requires two hands, and necessitates a strong twisting motion of the wrists and arms to both remove and securely replace it. A significant amount of grip-strength is also required to hold the cap while twisting it with sufficient torque to overcome the tight seal and break the connecting tabs that attach the cap to the separable tamper-evident safety ring that remains on the bottle after the cap is removed. This retained ring, which until the bottle is opened is attached to the removable cap, acts as a visible tamper-evident safety seal. These caps typically exhibit vertical ridges or other raised textures on their exterior to improve grip contact and minimize hand slippage, but they are usually shallow and often inadequate. The force required to initially twist the cap is sometimes so great that a separate tool is often employed to increase the user's mechanical advantage, overcome the friction and tension of the cap's tight seal on the bottle, break the safety tabs connecting the retained ring to the cap, and then remove the cap from the bottle.

Although both of these closures mentioned above have the ability to securely seal a particulate, fluid, or pressurized gas within the container, both are often difficult to remove and, except for rare circumstances, require two strong hands. Other closure technologies have been developed in recent years, such as flip-tops, pull-tops, toggle, and twist-spout caps, but none have the strength and sealable ability to hold a pressurized beverage contents, such as sparkling water, soda, or beer, securely within the container. Most of these closures are fine for water and other non-pressurized liquids, but for this reason pressurized beverages continue to be sold only with crown or twist caps. Although jars have often used large twist off tops and press-fit lids requiring a tool to remove, both of these closures are variations of those discussed above.

The market is ready for a simple, easy open closure that requires no tools, can be operated with one hand, and is capable of securely holding both pressurized and non-pressurized contents. Consumers, especially the increasing elderly population, young children, and others with compromised abilities, would readily embrace this technology, and see it as an improvement in customer-focused, ergonomic packaging design.

SUMMARY OF THE INVENTION

The present invention is directed to, in the first aspect, an improved container closure comprising: an improved internal cap closure mechanism consisting of strategically positioned locking lugs, which are designed to work in communication with a container's locking lip to securely attach such closure over the container's orifice.

In another aspect, the present invention is directed to an improved container closure comprising: an improved handle and fulcrum that is positioned to optimize function and mechanical advantage, wherein the handle over the fulcrum acts as a lever when squeezed against the sidewall of the container near the container's distal orifice to provide sufficient stretch and lift to remove the closure from the container.

In yet another aspect, the present invention is directed to an improved closure and container system comprising: a retro-fit sleeve that would enable the lever cap to be used with twist off bottles and other containers that currently can not communicate with the lever cap's inner locking mechanism, where the sleeve is fashioned to have an inner configuration capable of interfacing with such twist off bottles and other containers, and an exterior that is fitted to receive the lever cap, which would allow a wide variety of containers with dissimilar closure systems to be retro-fitted to use the lever cap.

In yet another aspect, the present invention is directed to an improved container closure comprising: a tamper-evident safety feature to indicate if the lever cap has been previously removed, and would deform and/or discolor the first time the handle is depressed against the sidewall of the container.

In yet another aspect, the present invention is directed to an improved closure and container system comprising: a specialized vertical sloping sidewall on the container near the container's distal orifice to improve the closure's stretch and vertical lift during operation.

In yet another aspect, the present invention is directed to an improved closure and container system comprising: a specialized child safety design and mechanism that provides a lever retention locking bar and locking thumb gate, which requires one function to lock the lever for safety and two functions to unlock and position it for normal operation.

In yet another aspect, the present invention is directed to an improved closure and container system comprising: certain ergonomic, aesthetic, and customizable features that improve its function, such as molded or insertable gaskets, and enhance consumer appeal, such as a unique finger ring design for holding and manipulating the handle and cap.

The closure may comprise one or more of the following features: (i) an improved interface on the interior surface of the closure that consists of strategically positioned locking lugs, instead of a full locking ring, to securely affix the closure onto a container, (ii) a repositioned lever handle and fulcrum to optimize function and mechanical advantage, (iii) a retro-fit sleeve for an incompatible container, which on the inner surface is fashioned to interface with twist necks bottles, or other closure designs and mechanisms incompatible with the interior fitting of the lever cap, and which on the exterior is fashioned to receive the interior fitting of the lever cap, (iv) a tamper-evident safety indicator, (v) a specialized vertical sloping sidewall at the container's distal end near the opening to improve the closure's vertical lift during operation, (vi) a child safety design and mechanism that requires two functions to unlock the lever and position it for normal operation, and (vii) certain ergonomic, aesthetic, and customizable features that improve its function and consumer appeal.

BRIEF DESCRIPTION OF THE DRAWINGS

The features of the invention believed to be novel and the elements characteristic of the invention are set forth with particularity in the appended claims. The FIGS. are for illustration purposes only and are not drawn to scale. The invention itself, however, both as to organization and method of operation, may best be understood by reference to the description of the preferred embodiment(s) that follows taken in conjunction with the accompanying drawings in that:

DETAILED DESCRIPTION OF THE INVENTION

Figure 1:
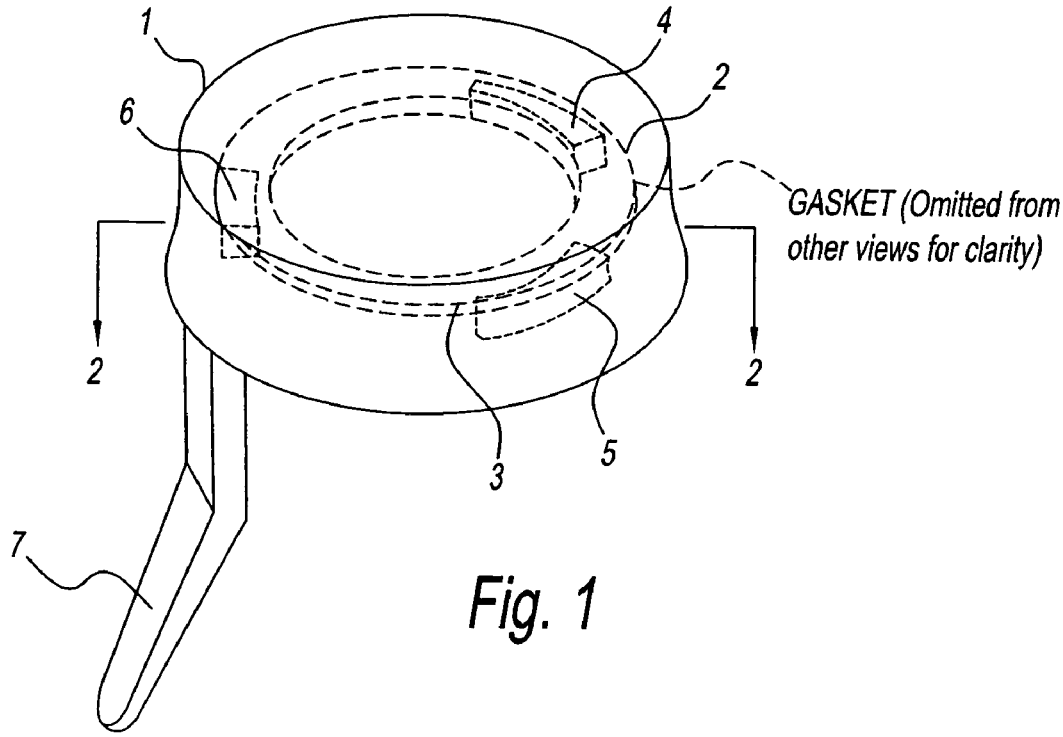
FIG. 1 is a schematic top/side view of the lever cap showing the internal locking lugs, handle, and the impervious gasket.
Figure 2:
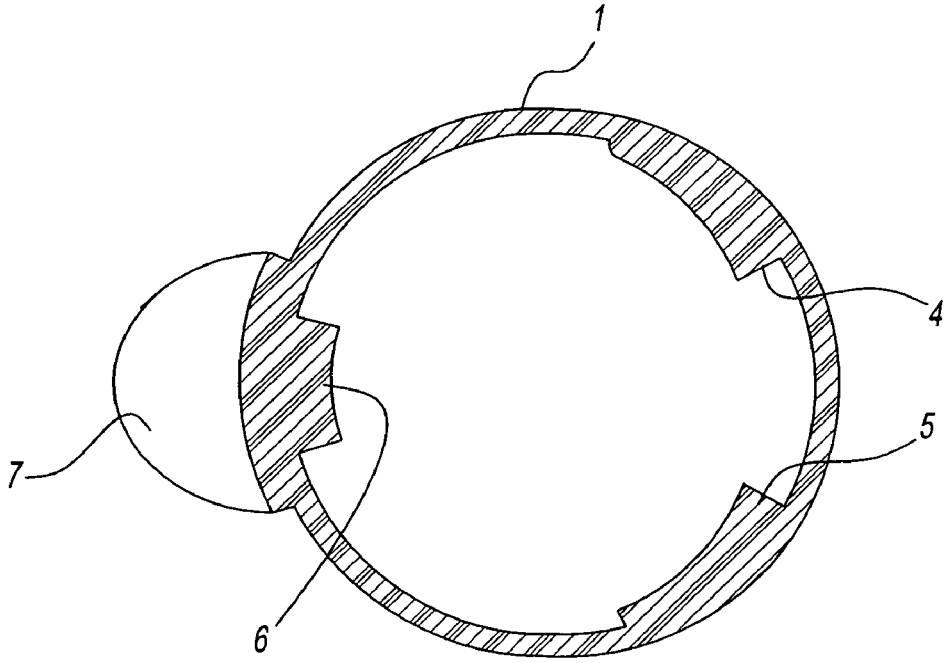
FIG. 2 is a schematic top view of the cap's inner locking mechanism and lever handle placement.

In describing the preferred embodiment of the present invention, reference will be made to FIGS. 1 through 18 of the drawings in that like numerals refer to like features of the invention. Features of the invention are not necessarily shown to scale in the drawings.

Locking Lugs and Handle Placement

The lever cap of the present invention is an improved device over prior designs in performance, ease of operation, and cost. The primary mechanical improvement of this closure over the prior case and all prior art involves using carefully positioned locking lugs on the inside of the closure, thereby eliminating the need for an entire bead to engage the container's lip, and the placement of the lever handle in relation to the locking lugs. As illustrated in FIG. 1, lever cap 1 is shown with gasket 2, the location of the outside edge of the container's locking lip 3, specially positioned locking lugs 4, 5, and 6, and handle 7. Locking lugs 4, 5, & 6 are an improvement to a solid locking ring on the interior of the cap for a number of reasons, and can comprise coverage as little as one third the circumference of such former solid locking ring.

First, the surface area of a solid locking ring as engaged against the container's locking lip is more that necessary to sealably secure a container's contents. Second, three appropriately positioned locking lugs provide all of the strength necessary to sealably secure most commercially available contents. Third, this triad of locking lugs presents less surface area and, therefore, provides a significantly easier impediment to overcome during the cap's removal.

Although the locking lugs could be of any number, size, shape, and location around the locking ring area on the underside of the cap, the first preferred design, depicted in FIGS. 1, 2, 3, & 4, would be three lugs, shaped and generally positioned as shown. Using the face of a clock for reference with the handle of the cap situated in the 6:00 o'clock position, while looking at the underside of the cap, there would be a lug 4 shown and shaped as depicted in FIGS. 1, 2, 3, & 4 at the 9:30 to 11:00 o'clock position. There would be another lug 5 shown and shaped as depicted in FIGS. 1, 2, 3, & 4 at the 1:00 to 2:30 o'clock position. Finally, there would be a third lug 6 shown and shaped as depicted at the 5:30 to 6:30 o'clock position near and opposite the handle. Certainly, different applications with different sized and shaped containers may require more or less locking lugs and handles in different shapes and configurations, but all such embodiments are contemplated herein. For example, and without limiting the foregoing, on a square, rectangular, or triangular shaped container, the locking lugs may be at the corners and more than one handle may be required. Additionally, the plurality of lugs can be substantially equidistantly dispersed about the circumference of the closure. Additionally, the lever cap can utilize other structures and techniques for providing the removable connection to the container, such as, for example, snap-fit, press-fit, friction-fit or other suitable means, or structures.

Operationally, the removal action is quite simple, and these improvements disclosed herein provide a simplified opening method. To remove the cap, only the locking lugs need to be separated from the container's lip. The user would hold the container in one hand and place either the thumb, the middle area of the hand between the thumb and the forefinger, or the pointer and/or middle finger against the lower part of the handle. Gripping the container firmly, the user would then apply a squeezing force against the handle in the direction of the container. As this force is applied, such force would be deflected, in part, off the sidewall of the container and transferred to the container's closure, thereby forcing at least a portion of the closure to stretch beyond the leading edge of locking lug 6. As the force continues, and because of the handle's shape and its angle to the container's sidewall, it would be expressed in an upward direction, thereby causing the cap to disengage from the lip of the container at locking lugs 4 & 5 to result in the complete release of the closure's hold on the container. Once the closure's hold is released, the cap would be easily removed from the container. The closure is reusable and can be replaced over the container's opening to sealable secure the container's contents for storage or transport.

In this first preferred embodiment, as shown in FIGS. 1, 2, 3, & 4, the shape of the locking lugs are designed to allow them to not only hold the cap firmly on the container, but to more easily slip over the container's locking lip when the cap is being removed from the container. The inner most edge of the locking lug 6 would be concaved shaped to closely follow the curvature of the container's lip. Locking lugs 4 & 5 would be further shaped to allow the leading edge of the locking lug, which would first experience the force of slipping over the container's lip, to be reduced in size to permit less material to initially pass over the container's lip. Furthermore, this particular shape would act like a wedge thereby permitting a gradual ramp up to the thicker portion of the locking lugs, which provide the majority of the security in firmly holding the cap onto the container's lip. The shape and configuration of these locking lugs would ease the process of removing the cap and require less force to be applied than if the cap's inner locking ring were fully engaged under the container's lip. Since less force is required to disengage the cap, then handle 7, depicted in FIGS. 1, 3, & 8-18 could be reduced in size and require less force to be applied against it to release the cap's hold on the container's lip. Likewise, since only the locking lugs need to engage the container's lip, less force will be required when replacing the cap onto the container. Many users, such as children and the elderly, will especially appreciate this ease in opening and resealing the cap. Furthermore, this locking lug structure would also allow the cap to be streamlined and save on the amount and cost of material during manufacture.

Figure 7:
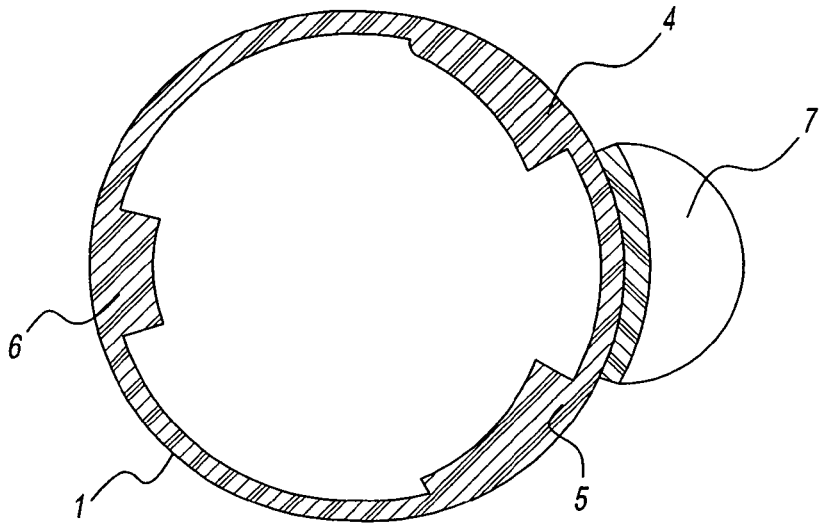
FIG. 7 is a schematic top view of the cap with an embodiment of an internal locking mechanism and lever handle location different from that disclosed in FIG. 2.

In a second and more preferred embodiment, depicted in FIG. 7, the three locking lugs 4, 5, & 6 would be positioned in similar fashion to the first preferred embodiment, but the handle would be positioned in the area near and opposite the space between locking lugs 4 & 5. The physical operation from the user's standpoint would be identical to that disclosed in the first embodiment. This most preferred embodiment would apply the greatest strength to the strongest area first, i.e., the widest part of locking lugs 4 & 5, resulting in an overall easier removal than that described in the first embodiment. As the force on the handle is applied, it would be deflected, in part, off the sidewall of the container and transferred to the container's closure, forcing at least a portion of the closure to stretch beyond the leading edges of locking lugs 4 & 5. Since the force on the handle would reach its highest level during the primary thrust against the container's sidewall, this effort should be directed to release the most significant points of resistance at the point of maximum mechanical advantage. The inner most edges of the locking lugs 4 & 5 would be concaved shaped and tailored to easily retreat off the curvature of the container's locking lip. Especially if these leading edges of locking lugs 4 & 5 were rounded, beveled, chamfered, catty-cornered or otherwise presented without a sharp corner, the handle in this location between locking lugs 4 & 5 would address the strongest resistance and most difficult removal points first, which would require the greatest amount of force, but, once passed, the balance of the operation would be significantly easier than that disclosed in the first embodiment since only the hold on the one locking lug 6 remains, rather than on two locking lugs. A continued upward force would easily result in removing the rest of the cap from the container.

The cap and appended handle could be formed from any appropriate material, including, without limitation, metal, plastic, fiberglass, or any suitable material or composite of materials by any suitable process, including stamping, molding, injection molding, thermoforming, or other appropriate process. A preferred material for manufacture would be plastic, and the most preferred choice from the polymer group would be a high-density polyethylene or variation, composite, or derivative thereof. Since the cap is intended to be reused numerous times, the selection of material offering optimum strength, stretch, sealability, and aesthetics would be important to its commercial success. Since some of the cap's intended uses would cause it to come in contact with food, beverages, medicine, and perhaps other products designed for human consumption, such materials for these applications may need to be compliant with the requirements of the U.S. Food and Drug Administration and could also include various additives, chemistries, and other means for antimicrobial protection for the benefit of the user, as well as for the integrity of the cap. Ideally, the cap with appended handle would be injection molded in one piece, but other suitable manufacturing methods could be employed by those skilled in the art, including, without limitation, the manufacture of the cap portion and handle portion separately, with subsequent assembly by adhesive, ultrasonic, heat staking, or other suitable method known to those skilled in the art. Additionally, the handle 7 can have upper and lower portions that are at an angle with respect to each other with the fulcrum portion 22 disposed between the upper and lower portions.

Figure 3:
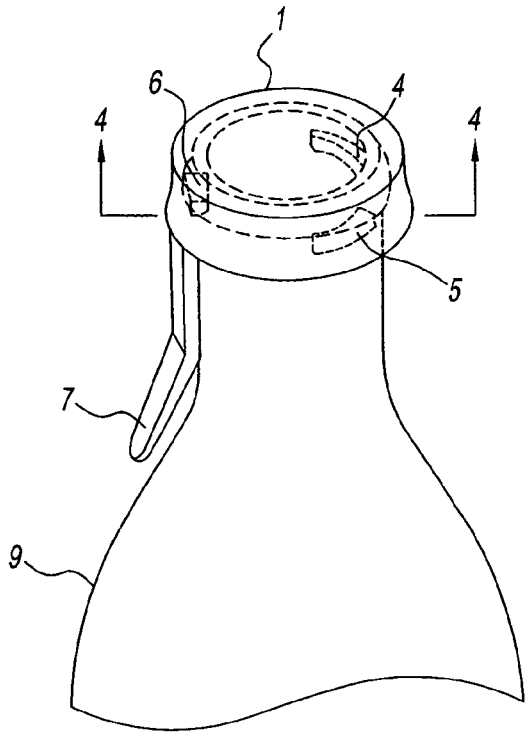
FIG. 3 is a schematic top/side view of the cap fully engaged on the neck of a bottle with the closure apparatus in the closed or engaged position.
Figure 4:
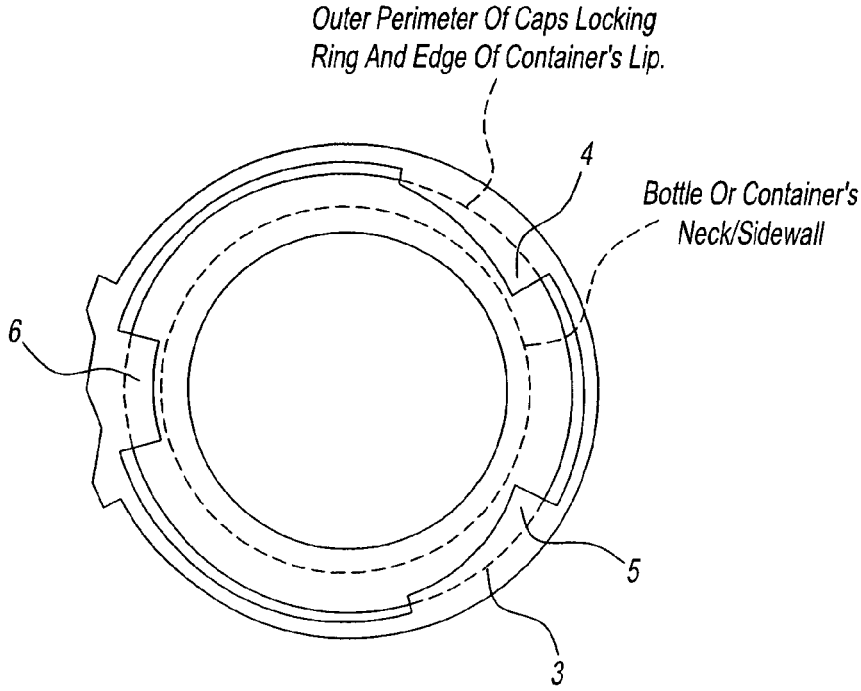
FIG. 4 is a schematic top view of the inner portion of the cap showing the locking lugs and the outer perimeter of the bottle's orifice and locking lip.
Figure 5:
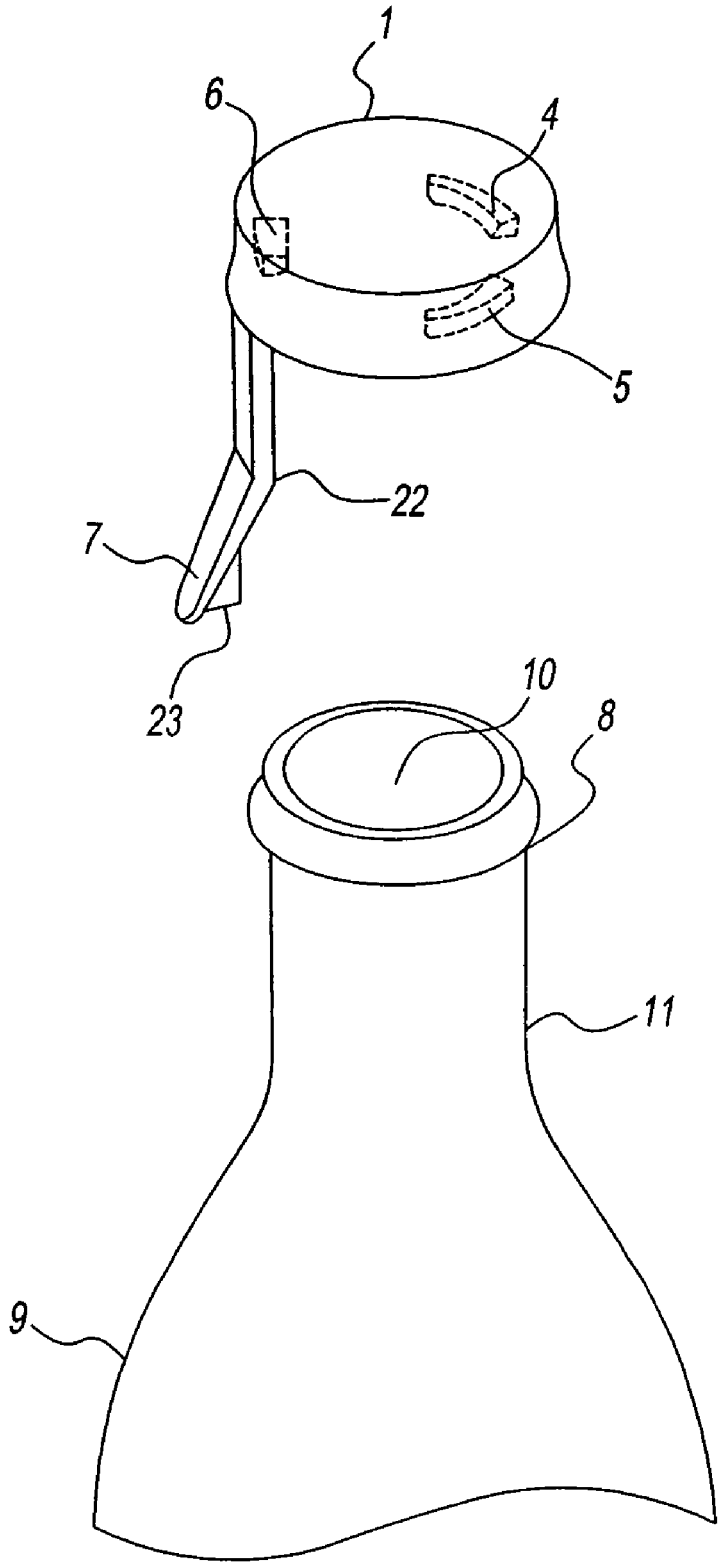
FIG. 5 is an exploded schematic top/side view of the cap and a bottle ready to receive the cap.

The method of use, as shown in exploded FIG. 5 would be to firmly snap or fit cap 1 onto container 9 and over container opening 10 such that locking lugs 4, 5 & 6 would slide over container locking lip 8 with the fulcrum 22 of handle 7 resting on or near the distal portion of container sidewall 11 near container opening 10 and below locking lip 8. FIG. 3 depicts cap 1 in the engaged or closed position on container 9, and FIG. 5 depicts cap 1 in the disengaged or open position. The method of removal of cap 1 from container 9 would be as described above.

Retro-Fit Sleeve

Figure 6:
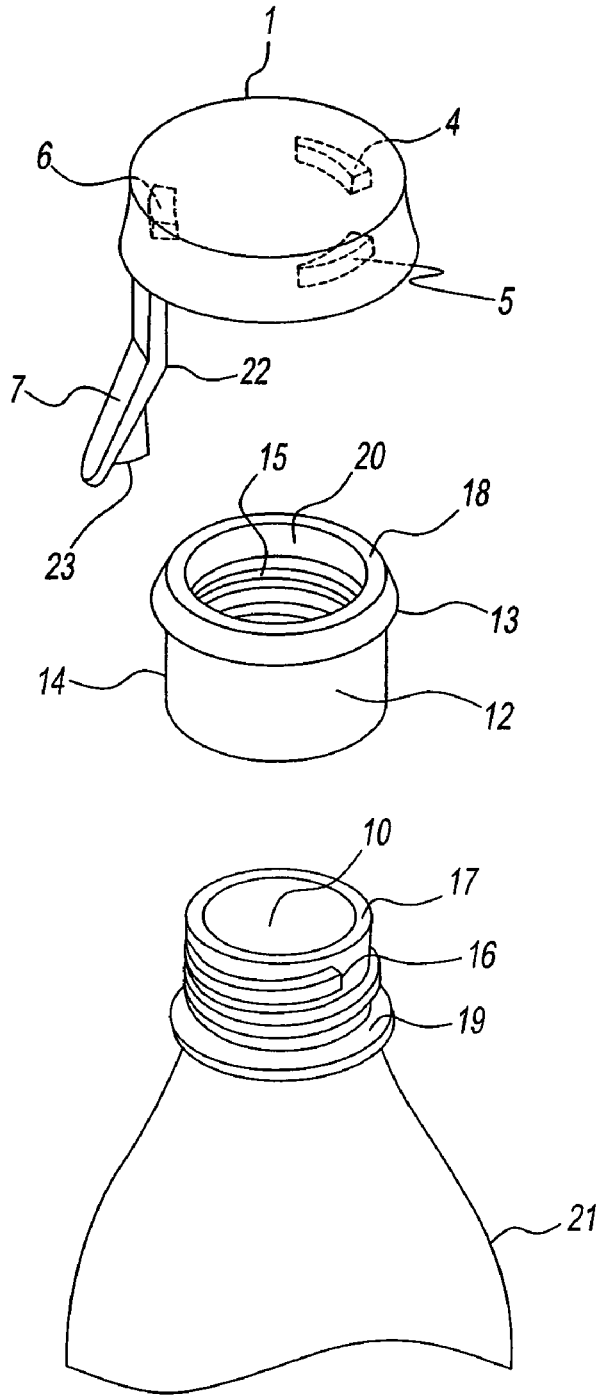
FIG. 6 is an exploded schematic top/side view of the cap, the retro-fit sleeve, and a twist on/off fitted bottle.

The lever cap can only be effectively used on a compatible container. In the event such cap is desired to be used on a container with an incompatible closing mechanism, a retro-fit sleeve or adapter may be used as an acceptable interface to preserve the use of the incompatible container and yet obtain the features and convenience of the lever cap. FIG. 6 illustrates the concept of the retro-fit sleeve in an exploded view. In this case, FIG. 6 depicts container 21 fashioned with a standard screw or twist-on closure mechanism, i.e., threads, common to many commercially available beverage containers. Retro-fit sleeve 12 is fashioned with an interior closing mechanism or securing structure 15 that is compatible with exterior closing mechanism or securing structure 16 of container 21. Of course, the securing structures can be other types that provide for securing of the sleeve to the container, such as, for example, a snap-fit or press-fit device. Retro-fit sleeve 12 is spun or otherwise fitted onto container 21 such that closing mechanisms 15 and 16 communicate to form a tight and impervious seal to liquids, particles, gases, fluids, and other substances, down to container stop ring 19, if present, which is standard on most beverage containers, such that container opening 10 and retro-fit sleeve opening 20 are flush across such openings at container top edge 17 and retro-fit sleeve top edge 18. Lever cap 1 would then be fitted onto retro-fit sleeve 12 across the joint openings at container top edge 17 and retro-fit sleeve top edge 18 such that handle 7 at fulcrum 22 rests on or near retro-fit sleeve sidewall 14 below retro-fit sleeve locking ring 13. The removal and refitting operation of cap 1 would be as described above, as if container 21 was originally fashioned to receive cap 1 without the interface of retro-fit sleeve 12.

Retro-fit sleeve 12 is shown in FIG. 6 with a vertical sidewall 14. However, it may also be fashioned with a specially contoured sidewall, including, without limitation, a sloped sidewall such as the one depicted as 25 on container 26 in FIG. 8 and described below.

Preferably, retro-fit sleeve 12 would be manufactured in the same way and from the same materials as described above for the lever cap, but, as determined by one skilled in the art, it may be fashioned in host of different ways and from different materials as may be dictated by each application.

Tamper-Evident Safety Indicator

Figure 8:
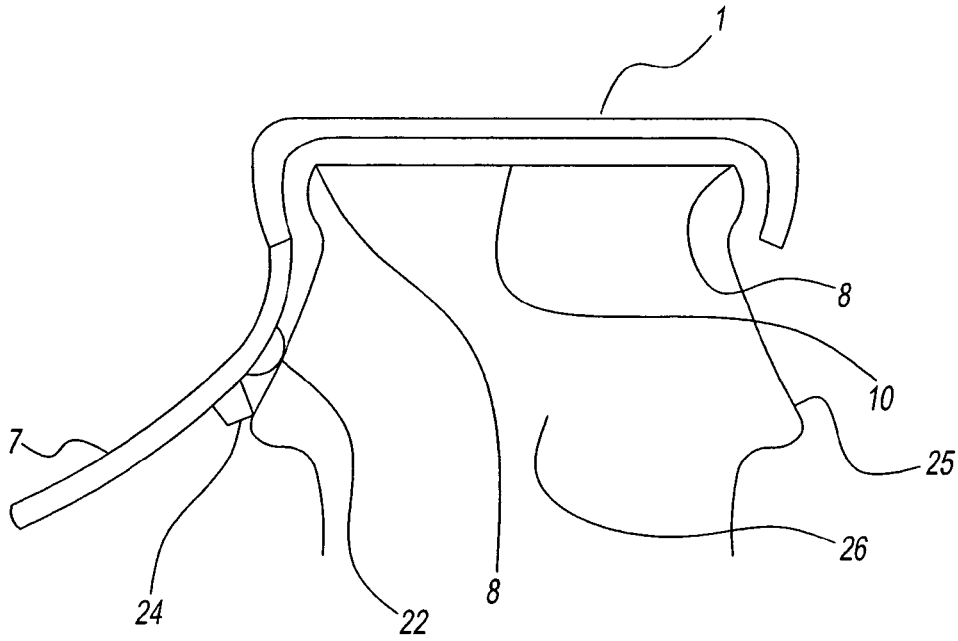
FIG. 8 is a schematic side view of the container and the cap with the tamper evident safety feature.

If the lever cap is to gain commercial acceptance for substances intended for human consumption or other specialized use where a consumer would want to know if the container had been previously opened, then an integrated tamper-evident safety feature, which would serve as an indicator that the cap had been previously removed, or the seal broken, may be a required or, at least, desired safety feature. Certainly, a cap could be shrink-wrapped for safety, as is common with pharmaceutical products, or a foil-like seal could be affixed across the container's opening under the cap, as is common with food products, but an integrated feature on the cap itself may have commercial benefit. A tamper-evident safety indicator depicted as 23 on FIGS. 6 and 24 on FIG. 8 may be used on lever cap 1 under lever handle 7 regardless of the container used. It may be used on container 9 straight vertical sidewall 11 as shown in FIG. 5, on the retro-fit sleeve 12 sidewall 14 as shown in FIG. 6, or on a specially contoured sloped sidewall 25 on container 26 as shown in FIG. 8, as described below. This type of tamper-evident safety feature would be comprised of a specially designed septum or angle that would deform and/or discolor the first time the handle is depressed against the sidewall of the container or otherwise actuated. These qualities could be effected as a result of the structure of such septum or the composition of the materials used in its construction, such as, for example, due to stress. Many such features are well known to those skilled in the art, and any number of them could be incorporated into the lever cap, all of which are contemplated herein. If desired, other commercially available safety features such as shrink-wrap packaging, and foil, foam, plastic, or paper covers affixed over the opening can be used in conjunction with the tamper-evident safety indicator. Additionally, the tamper evident device could be actuated based upon actuation of the handle and/or removal of the closure from the container and/or sleeve.

Sloping Sidewall

One of the principal mechanical improvements to the lever cap is its companion interface on the container at the point of the fulcrum's communication with the container's sidewall. As shown in FIGS. 8, 8*a*, 9, & 10, container 26 is fashioned with a vertical sloping sidewall 25. Although some bottle and packaging concepts have incorporated this kind of vertical sloping sidewall feature into their container design for a number of years, never before has such feature been used as an integral part of the container's cap removal process.

This sloping sidewall feature is a preferred embodiment to the cap's smooth, easy, and reliable removal on a regular basis. The principal requirement in removing any cap from a container is to attain vertical lift during the removal process. Applying a force horizontally, such as the force on the lever handle toward the container's sidewall, has to be translated into a vertical direction to remove the cap. Although workable with purely vertical sidewalls, there is a certain amount of inefficiency in this arrangement. However, if the container's sidewall could have a vertical sloping inclination off true center, such as that depicted in FIGS. 8, 8*a*, 9 & 10, then the horizontal force on the lever handle would be more efficiently translated into the vertical force necessary to drive the cap from the top of the container. The slope's angle of inclination is subject to change depending on the application, the size of the cap, and the minimum force desired to drive the cap vertically. Considering that any variation off a center plumb line would have some measure of benefit to aid in achieving vertical efficiency, all angles between true horizontal and true vertical are possible, and, therefore, contemplated herein, with a technically optimum preferred angle of 45 degrees.

Figure 12:
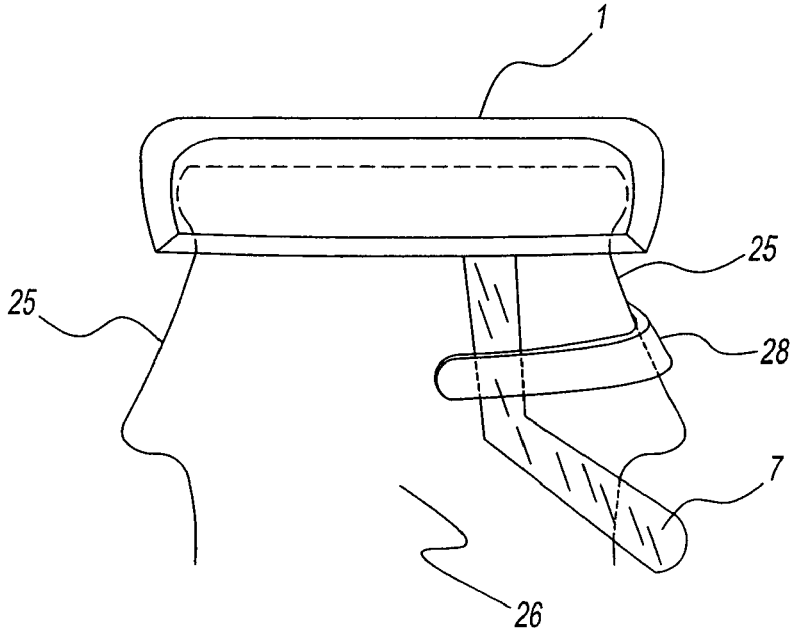
FIG. 12 is a schematic side view of the cap on a container with a safety locking bar and the lever handle in the engaged or locked position.

Furthermore, a curved slope, as shown by slope 25 in FIG. 12, is also contemplated with changing angles of inclination over the distance of the sloping portion, which could assist in the cap's removal in certain applications. However, depending on the materials used and the desired benefits to be achieved in each situation, each application will dictate the optimum angle or angles of inclination for the slope of the sidewall.

Figure 8A:
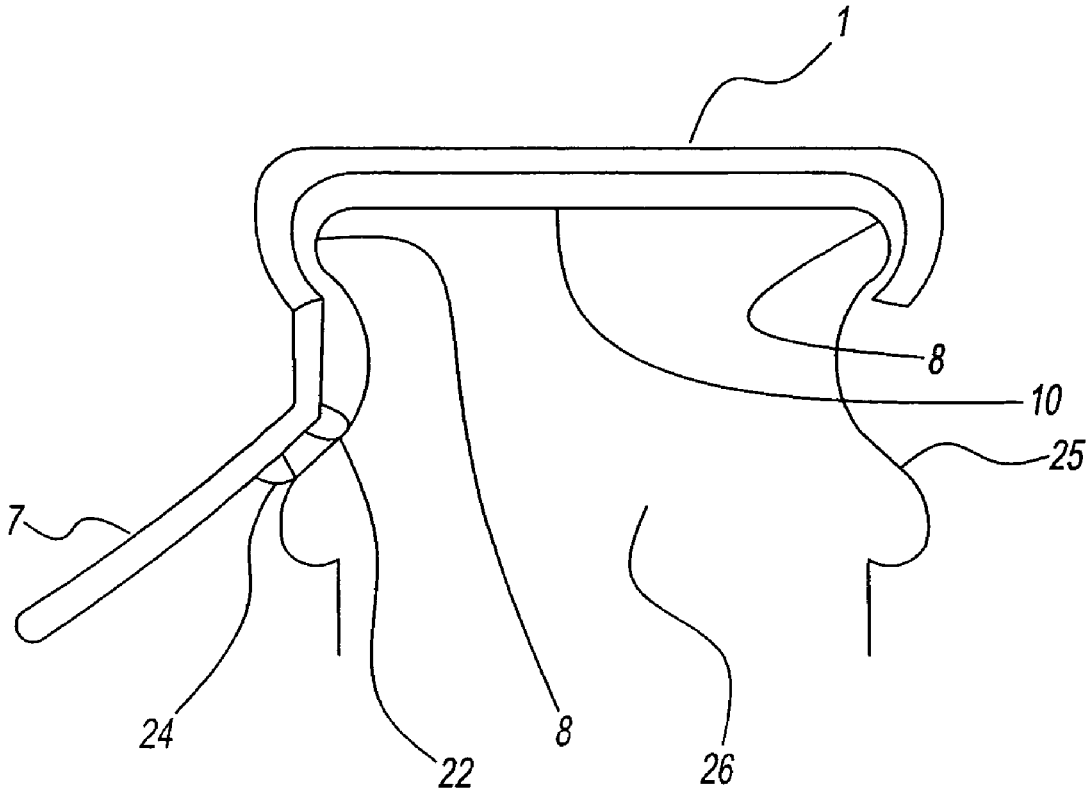
FIG. 8*a* is a schematic side view of the cap with the tamper evident safety feature and the container with a non-linear sidewall for improved leverage.

As shown in FIG. 8*a*, the slope of the sidewall can also be non-linear, such as, for example, a reverse S-like shape. Such shapes facilitate removal of the closure and improve the leverage of the handle 7.

The fulcrum, which is the point of communication between the container sidewall and the cap's handle, is important and subject to change in each application. The factors necessary to its successful use, a part of which is maximizing the handle's force efficiency, would be its size, shape, configuration at the point of contact with the container's sidewall, the contour of the container's sidewall, and its coefficient of friction resulting from its design and the materials used in its composition. All of these factors need to be taken into account by one skilled in the art to design the optimal match between the handle's fulcrum and the container's sidewall to achieve a point of interface which minimizes the attendant friction and maximizes the strength of the handle and the efficiency of the amount of force required to remove each cap in each application. General guidance would include a shape and point of contact at the bottom of the fulcrum to be as small, smooth, and strong as practicable to reduce the friction between the fulcrum and the container sidewall during operation and the selection of polymeric or other suitable materials that balance strength, rigidity, and the optimal coefficient of friction to achieve a strong, slippery surface at the interface between the fulcrum and the sidewall. Certainly, coatings, treatments, and finishing techniques could be employed by one skilled in the art during manufacture to maximize these factors and all such materials, shapes, contours, designs, configurations, and embodiments are contemplated herein.

Figure 9:
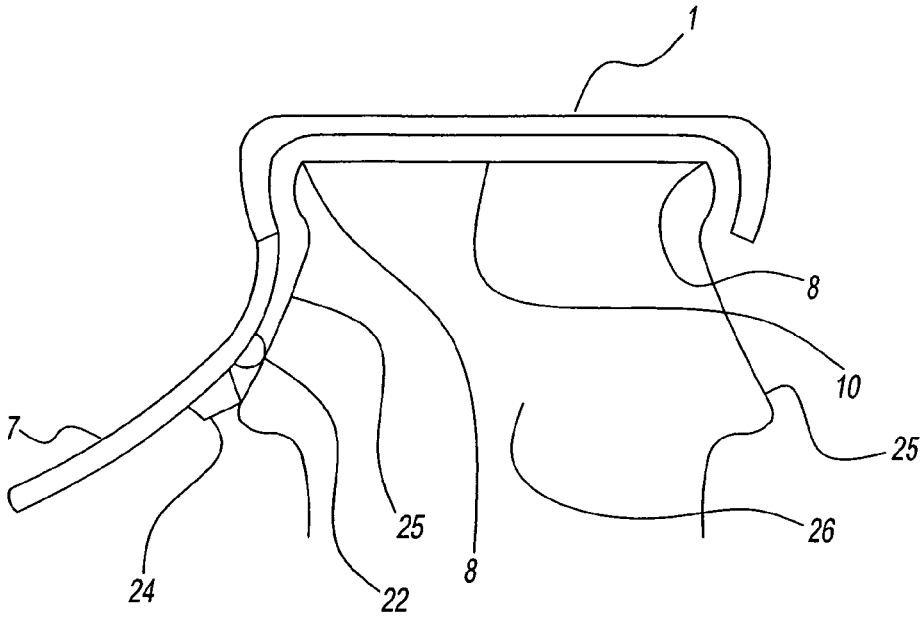
FIG. 9 is a schematic side view of the container and the cap with the lever handle and cap in the closed or engaged position.
Figure 10:
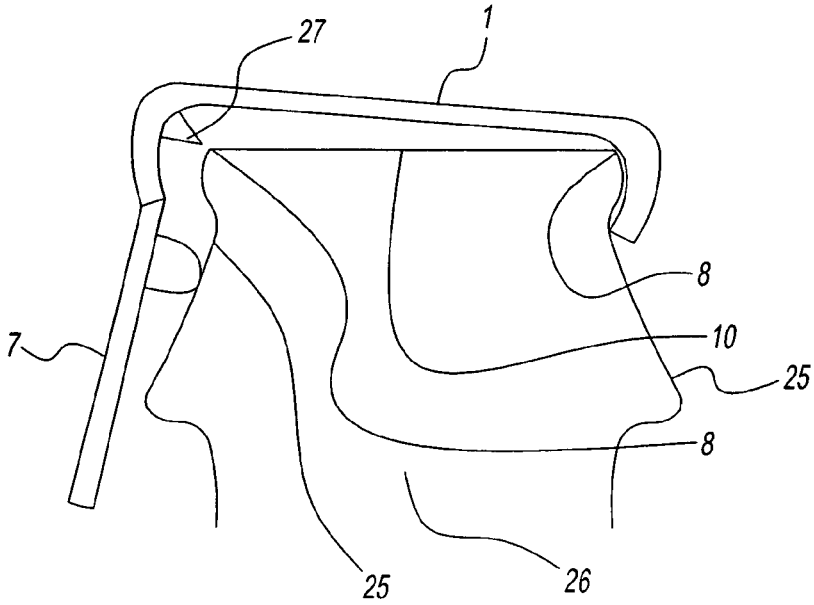
FIG. 10 is a schematic side view of the container and the cap with the lever handle and cap in the partially open or partially disengaged position.

Operationally, the cap's removal from a sloping sidewall container is very similar to its removal from a vertical sidewall container. Referring to FIGS. 9 & 10, cap 1 is held onto container 26 at locking lip 8 and over covering opening 10. Handle 7 with fulcrum 22 is adjacent to and in communication with sloping sidewall 25 in both the cap's engaged or closed position in FIG. 9 and in the partially disengaged or partially open position in FIG. 10. Force applied to handle 7 in the direction of container sidewall 25 causes fulcrum 22 to slide up sidewall 25 to drive one or two locking lugs, depending on the embodiment used, shown generally at point 27 on the inside of cap 1 in FIG. 10, over and past container locking lip 8. Once locking lug(s) 27 are free of container locking lip 8, the rest of cap 1 can easily be removed from the remainder of the locking lug(s) on the opposite side of the interior of the cap. Although described here with reference to the locking lugs, the sloping sidewall design can be used with a continuous locking ring on the inside of the cap, but such embodiment is not preferred.

Many other embodiments will be apparent to one skilled in the art, and all of them are contemplated herein without departing from the spirit of the present invention.

Safety Locking Bar

Figure 11:
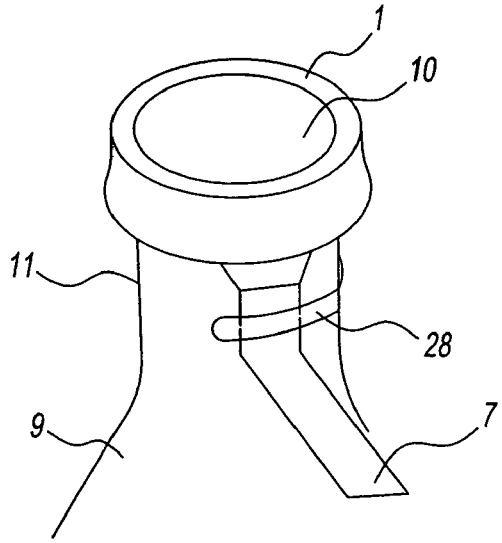
FIG. 11 is a schematic top/side view of the cap on a container with a safety locking bar and the lever handle in the engaged or locked position.

In pharmaceutical and other applications where it would be important to restrict access to the contents of the container for certain segments of the population, such as children and those with certain disabilities, an impediment to easily opening the container will be a required or at least highly desired safety feature. One design that would work with the lever cap is disclosed in FIGS. 11-16. As shown in FIGS. 11 and 12, this safety locking bar can be employed on containers with either vertical or sloped sidewalls.

Figure 13:
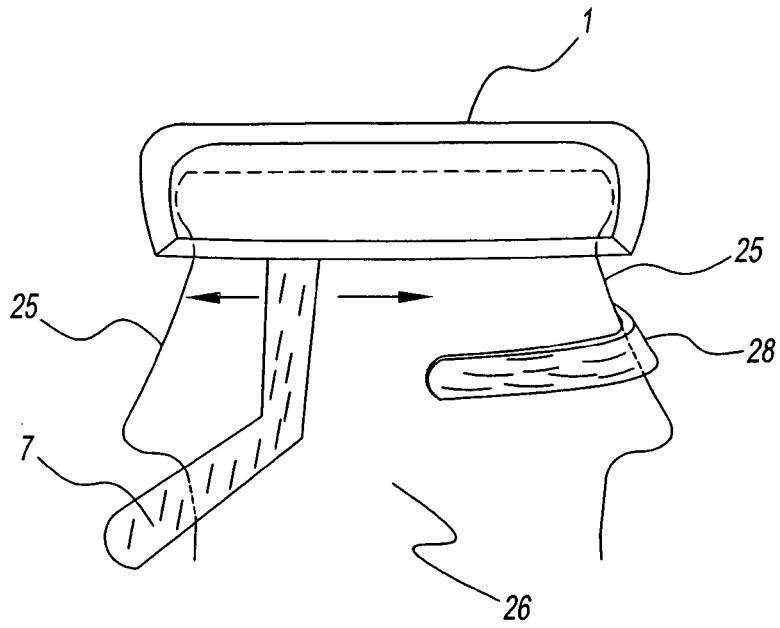
FIG. 13 is a schematic side view of the cap on a container with a safety locking bar and the lever handle in the disengaged or unlocked position.
Figure 14:
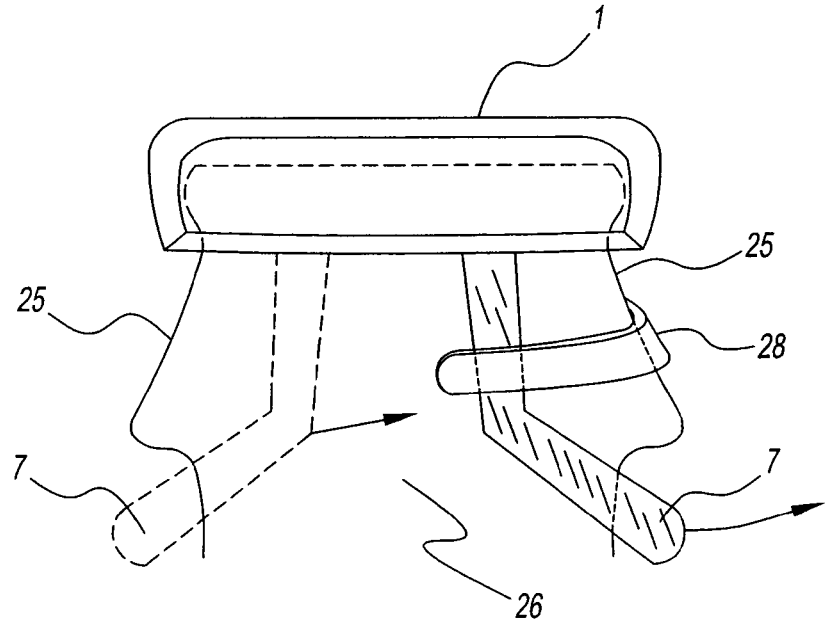
FIG. 14 is a schematic side view of the cap on a container with a safety locking bar and the cap with lever handle twisting from a disengaged or unlocked position to an engaged or locked position.

Operationally, cap 1 would be placed on container 9 with vertical sidewall 11, as shown in FIG. 11 or on container 26 with sloped sidewall 25, as shown in FIGS. 12, 13 & 14. Safety locking bar 28 would be affixed to container 9 or container 26 as an integral part of such container's construction or fastened onto such container after its initial manufacture. Safety locking bar 28 would be affixed to sleeve 12 as an integral part of such sleeve's construction or fastened onto such sleeve after its initial manufacture. The purpose of the safety locking bar is to prevent any vertical movement of the handle to cause the removal of the cap. Once the cap is placed on the container, it is rotated, as shown in FIG. 14, so that lever handle 7, shown in the open or disengaged position in FIG. 13, slides under safety locking bar 28, as shown in the closed or engaged position in FIGS. 12 & 14. In a preferred embodiment, handle 7 would slide under safety locking bar 28 in the area at or near that point on handle 7 opposite the fulcrum, which area is subject to adjustment depending on the design of the handle, cap, and container. In this position, safety locking bar 28 would prevent any force on the handle from causing it to slide vertically upward in the direction of the cap. The handle can require movement in two or more directions as an added safety feature.

Figure 15:
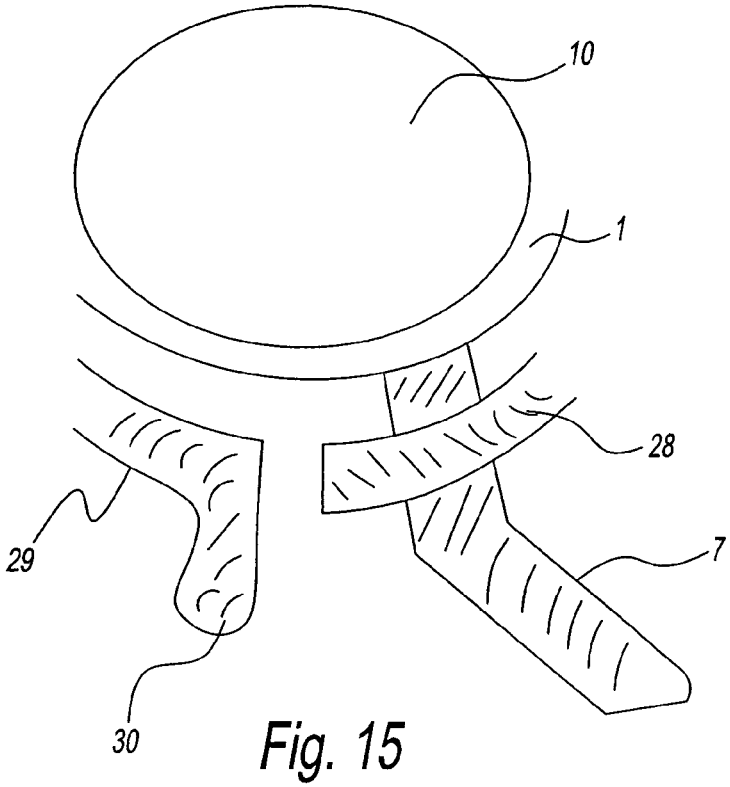
FIG. 15 is a schematic side view of the cap on a container with a depressible thumb gate and non-overlapping safety locking bar with the cap's lever handle in the engaged or locked position.
Figure 16:
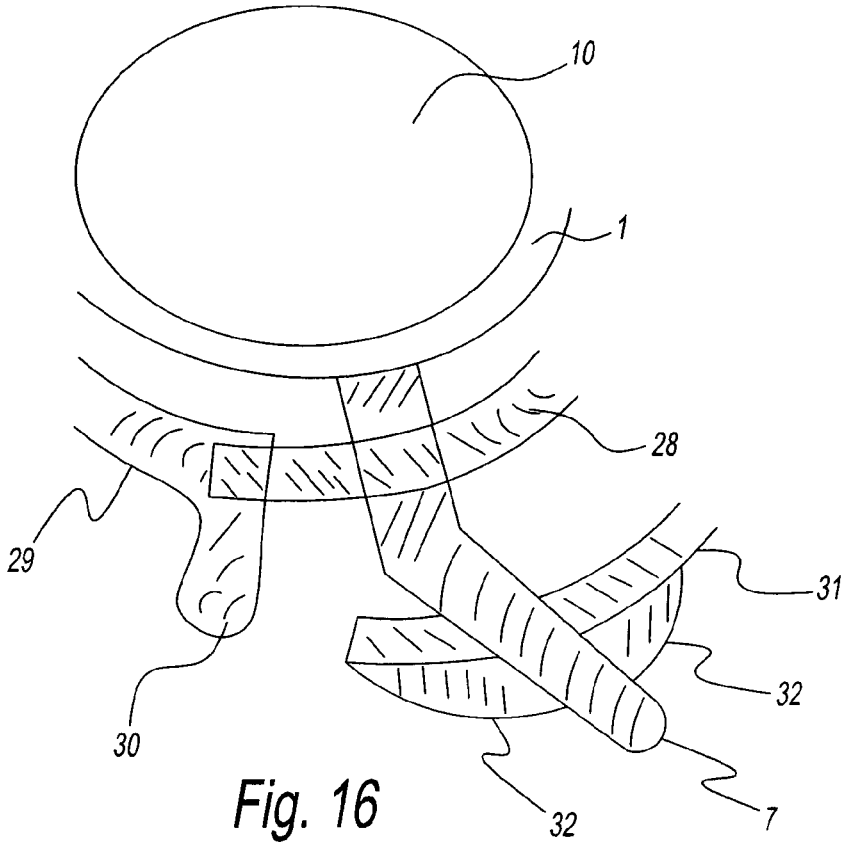
FIG. 16 is a schematic side view of the cap on a container with a depressible thumb gate and overlapping safety locking bar with the cap's lever handle in the engaged or locked position.

In addition, to prevent handle 7 from being easily rotated out from under safety locking bar 28, thumb gate 29, as shown on FIGS. 15 & 16 would serve as a stop block or locking mechanism. Thumb gate 29 would be an integral part of the container or sleeve, and would be depressible in nature with a built-in natural spring-like action or otherwise actuatable to allow rotation of the handle 7 out from under the locking bar 28. As shown in FIGS. 15 & 16, thumb gate 29 could be located adjacent to safety locking bar 28, as shown on FIG. 15 or partially underneath safety locking bar 28, as shown on FIG. 16. As handle 7 is rotated toward and under safety locking bar 28, thumb gate 29 would depress in toward the container. After handle 7 is cleared past thumb gate 29, the thumb gate would spring outward and at least approximately even with handle 7 to prevent it from being rotated out from under safety locking bar 28.

To remove handle 7 out from under safety locking bar 28 to position the lever cap for normal use at any other point around the container, a second operation would be required, in that thumb gate 29 would have to be depressed in toward the container at or around tab 30, while the cap is rotated until the handle passes over the thumb gate and is out from under safety locking bar 28. Thumb gate 29 would be affixed to container 9 or container 26 as an integral part of such container's construction or fastened onto such container after its initial manufacture. Thumb gate 29 would be affixed to sleeve 12 as an integral part of such sleeve's construction or fastened onto such sleeve after its initial manufacture.

In a more preferred embodiment, also shown in FIG. 16, an additional rib 31 could be fashioned onto the sidewall of the container in the area below safety locking bar 28, so that when handle 7 is rotated under the safety locking bar, this rib 31 would be positioned under the lower lever portion of handle 7 to prevent it from being depressed toward the container. As a refinement to this design, this rib could be ramped on one or both sides, as shown at points 32 on FIG. 16, so that it is at its highest elevation, preferably in a middle portion thereof, under the handle when such handle is below safety locking bar 28, and non-existent or flush with the sidewall of the container outside this area. Rib 31 would be affixed to container 9 or container 26 as an integral part of such container's construction or fastened onto such container after its initial manufacture. Rib 31 would be affixed to sleeve 12 as an integral part of such sleeve's construction or fastened onto such sleeve after its initial manufacture.

Ideally, in a preferred embodiment, the safety locking bar, thumb gate, and rib would be integral to the container or sleeve and molded as part of such container or sleeve's manufacture, respectively. Consistent with the manufacture of the cap and retro-fit sleeve, the safety locking bar, thumb gate, and rib could be formed from any appropriate material, including, without limitation, metal, plastic, fiberglass, or any suitable material or composite of materials by any suitable process, including stamping, molding, injection molding, thermoforming, or other appropriate process. A preferred material for manufacture would be plastic, and the most preferred choice from the polymer group would be a high-density polyethylene or variation, composite, or derivative thereof. Since in the preferred embodiment, the safety locking bar, thumb gate, and rib would be integral to the container or sleeve and molded as part of such container or sleeve's manufacture and some of such container/sleeve's intended uses might cause it to come in contact with food, beverages, medicine, and perhaps other products designed for human consumption, such materials for these applications may need to be compliant with the requirements of the U.S. Food and Drug Administration and could also include various additives, chemistries, and other means for antimicrobial protection for the benefit of the user, as well as for the integrity of the container, sleeve, safety locking bar, thumb gate, and rib.

Ergonomic and Aesthetics Features

Figure 17:
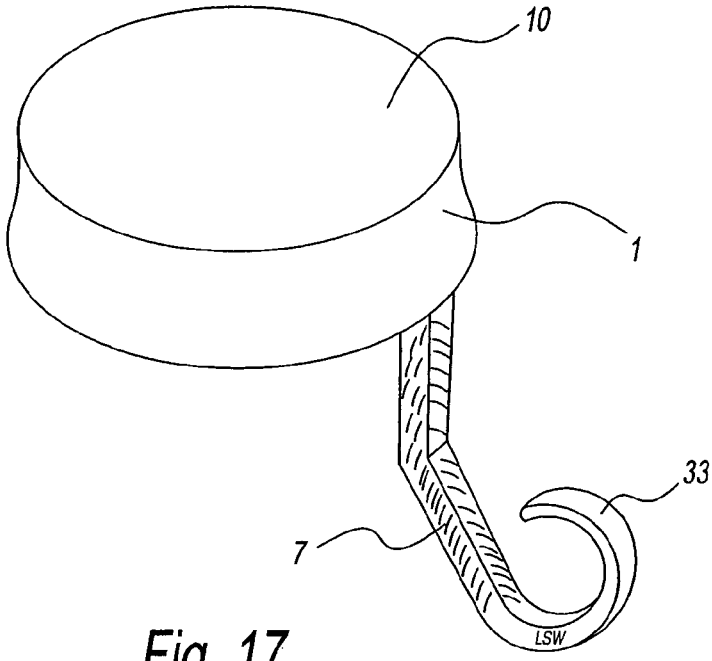
FIG. 17 is a schematic top/side view of the cap with customized ergonomic and aesthetic features.
Figure 17A:
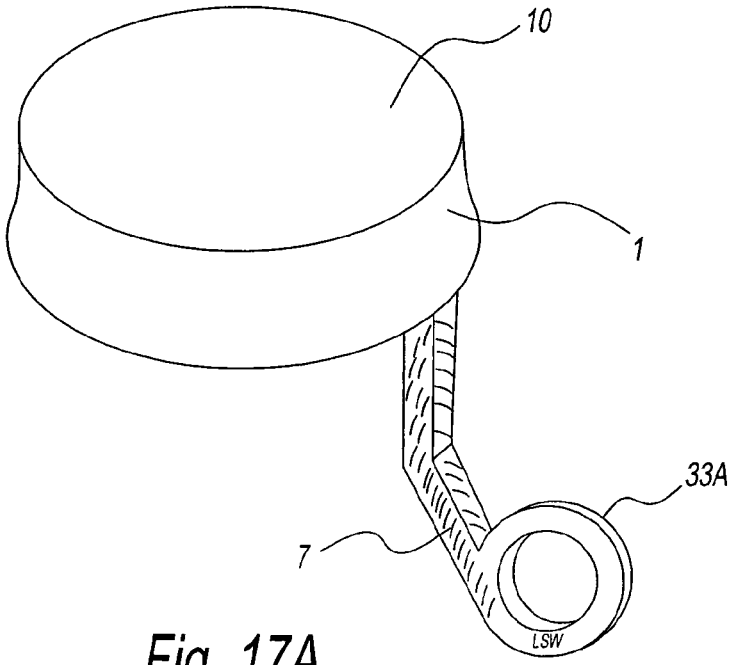
FIG. 17*a* is a schematic top/side view of an alternative cap with customized ergonomic and aesthetic features.

One other aspect of the lever cap that will contribute to its use, acceptance, and commercial success is its ability to be customized to meet consumer preferences. For instance, as disclosed in FIG. 17, many ergonomic features could be incorporated, such as, for example, a gripping portion having a size and shape adapted to facilitate gripping and manipulation by a user. In the exemplary embodiment of FIG. 17, the gripping portion is an open finger ring design 33 at a distal end of the handle, where the user can insert his or her pointer or middle finger such that when the handle is depressed, the user can simply flip the cap off the container with a flick of his/her finger while holding the container with the rest of the same hand. Of course, other sizes and shapes of gripping portions can also be used. Likewise, by holding the cap by the finger ring, the user could recap the container by bringing the cap back into contact with the top of the container, engaging the locking lug(s) on the opposite side of the cap from the handle, and, once engaged, pulling down on the handle side of the cap to engage the locking lug(s) near the handle. Therefore, both the removal and recapping of the container can be accomplished with one hand. Furthermore, as shown in FIG. 17, numerous other consumer-friendly and aesthetic designs, advertising logos, colorations, material changes and inlays for different textures and feel can be used without departing from the original spirit of the present invention and are well known to those skilled in the art. In a preferred embodiment shown in FIG. 17*a*, the finger ring is a closed loop or ring 33*a*. Additionally, other shapes, designs, or numbers of gripping portions can be used to facilitate manipulation of the handle, such as, for example, open rings (such as open ring 33 of FIG. 17), ovals, hooks, and/or double or multiple rings on the handle, which handle could be of any shape, size, or configuration to receive such gripping portions.

Customizable for Different Applications

Figure 18:
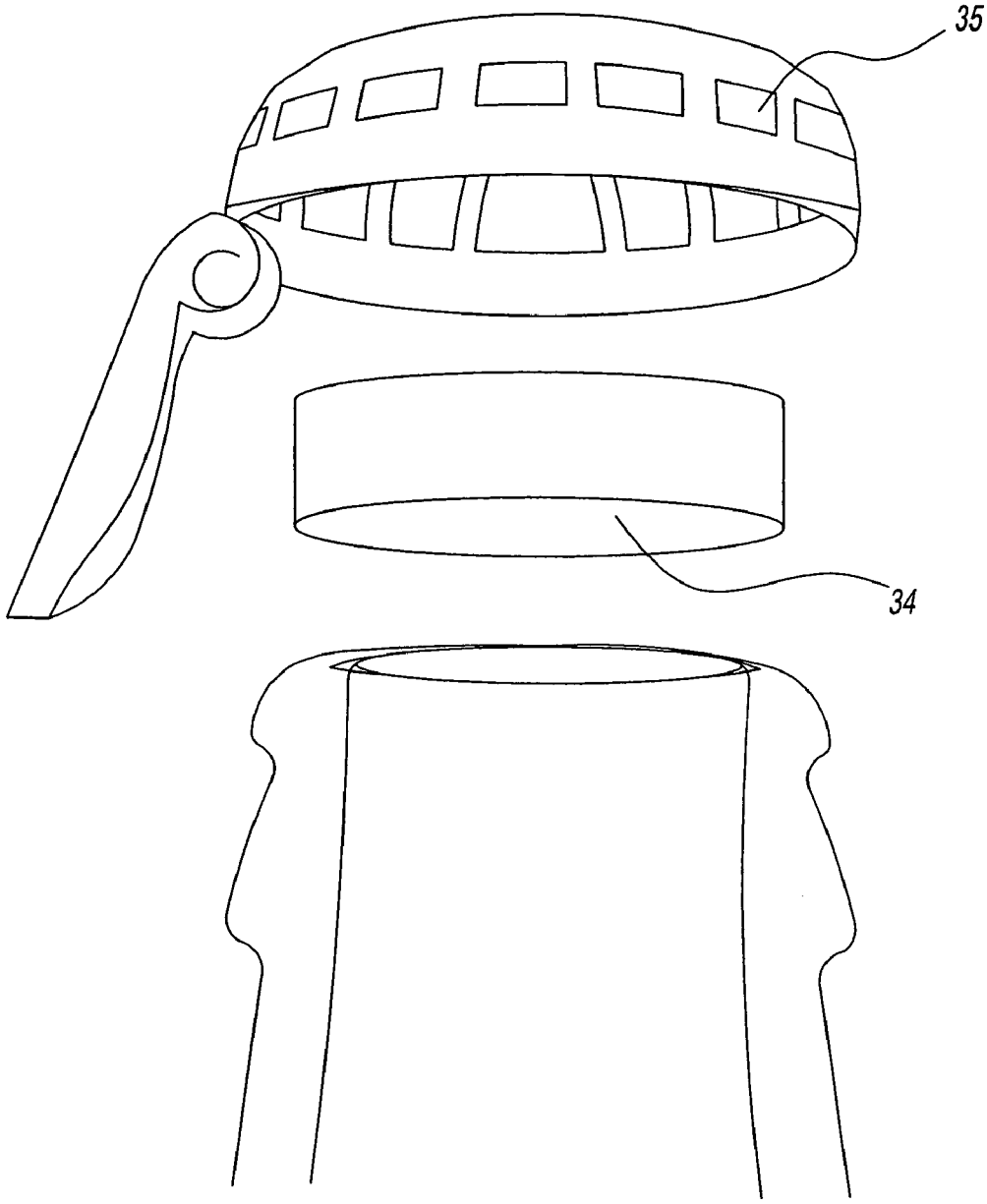
FIG. 18 is an exploded schematic side view of the cap, a separate fluid/gas impervious gasket, and container.

Another feature that adds to the lever cap's appeal is its ability to be customized for various applications. For instance, as disclosed in FIG. 18, the cap's use for beverages will require an impervious seal to prevent leaks. In other applications the seal might need to be impervious to one or a combination of particulates, liquids, fluids, and gasses. As is well known in the art, a gasket could be molded into the cap as an integral part of its construction, or a different one could be separately prepared from more suitable materials with more appropriate features for the application in question and inserted into the cap after manufacture. Separate gasket 34, as shown in FIG. 18, is an example of this type of customization. In addition, many other customized features could be incorporated into the cap design, including, without limitation, options such as windows 35 around the side of the cap to allow escaping gas from pressurized contents to be released quickly before the entire cap is removed from the container.

The cap is customizable and scalable for different applications and its flexibility will add to its appeal and its acceptance.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternative, modifications, and variations as falling within the true scope and spirit of the present invention.

What is claimed:

1. An easy open, reusable, removable closure apparatus for a container having a terminal end with an orifice and a radially outwardly extending edge having an outer surface and a radially outwardly extending undercut below said edge, the closure apparatus comprising:

a cap portion having a top, a peripherally depending sidewall comprising an inner surface that conforms to said container outer surface and one or more radially inwardly extending lugs that engage a portion of said edge undercut thereby sealably securing said closure to said container, wherein a material housed by said container is secured in said container by said cap portion;

a handle depending from said cap portion, said handle comprising a fulcrum portion that abuts a portion of the surface of the outer sidewall of said container near the terminal end orifice; and a tamper indicator that becomes deformed when said handle is actuated or the closure is removed from the container, wherein said tamper indicator is positioned on an inner surface of said handle and becomes deformed by contact with the outer sidewall of the container when said handle is actuated or the closure is removed from the container.

2. An easy open, reusable, removable closure apparatus for a container having a terminal end with an orifice and a radially outwardly extending edge having an outer surface and a radially outwardly extending undercut below said edge, the closure apparatus comprising:

a cap portion having a top, a peripherally depending sidewall comprising an inner surface that conforms to said container outer surface and one or more radially inwardly extending lugs that engage a portion of said edge undercut thereby sealably securing said closure to said container, wherein a material housed by said container is secured in said container by said cap portion; and a handle depending from said cap portion, said handle comprising a fulcrum portion that abuts a portion of the surface of the outer sidewall of said container near the terminal end orifice, wherein said cap portion has a gasket that abuts the terminal end of the container when the closure is sealably secured to the container.

3. An easy open, reusable, removable closure system for a container having a terminal end with an orifice and a container securing structure, the system comprising:

a sleeve having a sleeve securing structure and a radially outwardly extending edge with an outer surface and a radially outwardly extending undercut below said edge, said sleeve securing structure being connectable to the container securing structure thereby securing said sleeve to the container;

a cap portion having a top, a peripherally depending sidewall comprising an inner surface that conforms to said sleeve outer surface and one or more radially inwardly extending lugs that engage a portion of said edge undercut thereby sealably securing said closure to said sleeve, wherein a material housed by the container is secured in the container by said cap portion when said sleeve is secured to the container; and a handle depending from said cap portion, said handle comprising a fulcrum portion that abuts a portion of either the surface of the outer sidewall of said sleeve or the container, wherein said sleeve securing structure is inwardly extending threads.

4. The system of claim 3, wherein said sleeve has a locking bar that substantially prevents vertical movement of said handle when said handle is positioned between said locking bar and said sleeve.

5. The system of claim 4, wherein said sleeve has a rib that substantially prevents movement of said handle towards said sleeve when said handle is positioned between said locking bar and said rib.

6. The system of claim 5, wherein a middle portion of said rib extends farther from said sleeve than an end of said rib extends from said sleeve.

7. The system of claim 4, wherein said sleeve has a locking mechanism that prevents said handle from being rotated out from under said locking bar unless said locking mechanism is actuated.

8. The system of claim 7, wherein said locking mechanism is a thumb gate that is resiliently depressible towards said sleeve thereby allowing said handle to be rotated out from under said locking bar.

9. The system of claim 8, wherein said thumb gate is at least partially disposed between said locking bar and said sleeve.

10. An easy open, reusable, container system comprising:

a container having a terminal end with an orifice and a radially outwardly extending edge with an outer surface and a radially outwardly extending undercut below said edge;

a cap portion having a top, a peripherally depending sidewall comprising an inner surface that conforms to said container outer surface and one or more radially inwardly extending lugs that engage a portion of said edge undercut thereby sealably securing said closure to said container, wherein a material housed by said container is secured in said container by said cap portion; and a handle depending from said cap portion, said handle comprising a fulcrum portion that abuts a portion of the surface of the outer sidewall of said container near the terminal end orifice, wherein said portion of the surface of the outer sidewall of said container abutted by said fulcrum portion is at an angle with respect to vertical.

11. The container system of claim 10, wherein said portion of the surface of the outer sidewall of said container abutted by said fulcrum portion has a non-linear shape.

12. The container system of claim 10, wherein said one or more radially inwardly extending lugs is a plurality of said lugs dispersed around a circumference of said edge undercut to engage a portion of said edge undercut thereby sealably securing the closure to said container.

13. The container system of claim 12, wherein said plurality of lugs is substantially equidistantly dispersed around said circumference of said edge undercut.

14. The container system of claim 10, wherein said handle communicates and depends from said sidewall and extends radially downward and away from said container.

15. The container system of claim 10, wherein either said cap portion or said handle has a tamper indicator that becomes deformed when said handle is actuated or said closure is removed from said container.

16. The container system of claim 10, wherein at least a portion of said handle and/or said cap portion changes color when said handle is actuated.

17. The container system of claim 10, wherein said container has a locking bar that substantially prevents vertical movement of said handle when said handle is positioned between said locking bar and said container.

18. The container system of claim 17, wherein said container has a rib that substantially prevents movement of said handle towards said container when said handle is positioned between said locking bar and said rib.

19. The container system of claim 18, wherein a middle portion of said rib extends farther from said container than an end of said rib extends from said container.

20. The container system of claim 17, wherein said container has a locking mechanism that prevents said handle from being rotated out from under said locking bar unless said locking mechanism is actuated.

21. The container system of claim 20, wherein said locking mechanism is a thumb gate that is resiliently depressible towards said container thereby allowing said handle to be rotated out from under said locking bar.

22. The container system of claim 21, wherein said thumb gate is at least partially disposed between said locking bar and said container.

23. A method of opening a container using an easy open, reusable, removable closure apparatus for a container having a terminal end with an orifice and a radially outwardly extending edge having an outer surface and a radially outwardly extending undercut below said edge, the closure apparatus comprising:

a cap portion having a top, a peripherally depending sidewall comprising an inner surface that conforms to said container outer surface and one or more radially inwardly extending lugs that engage a portion of said edge undercut sealably securing said closure to said container, wherein a material housed by said container is secured in said container by said cap portion; and a handle depending from said cap portion, said handle comprising a fulcrum portion that abuts a portion of the surface of the outer sidewall of said container near the terminal end orifice; the method comprising:

holding said container and the lower handle portion of said handle simultaneously with at least one hand; and depressing said lower handle portion towards said container until said one or more radially inwardly extending lugs disengages said container's edge undercut.

24. The method of claim 23, wherein said handle must be moved in at least two directions to remove the closure apparatus from the container.

25. The method of claim 23, further comprising resealing the container with the cap portion by engaging said one or more radially inwardly extending lugs with said container's edge undercut.

26. The method of claim 23, wherein said container and the lower handle portion of said handle are simultaneously held with only one hand when removing or securing the closure to the container.

27. A method of opening a container using an easy open, reusable, removable closure system for a container having a terminal end with an orifice and a container securing structure, the closure system comprising:

a sleeve having a sleeve securing structure and a radially outwardly extending edge with an outer surface and a radially outwardly extending undercut below said edge, said sleeve securing structure being connectable to the container securing structure thereby securing said sleeve to the container;

a cap portion having a top, a peripherally depending sidewall comprising an inner surface that conforms to said sleeve outer surface and one or more radially inwardly extending lugs that engage a portion of said edge undercut thereby sealably securing said closure to said sleeve, wherein a material housed by the container is secured in the container by said cap portion when said sleeve is secured to the container; and a handle depending from said cap portion, said handle comprising a fulcrum portion that abuts a portion of either the surface of the outer sidewall of said sleeve or the container; the method comprising:

engaging said sleeve securing structure with said container securing structure thereby connecting said sleeve with said container;

holding said container and/or said sleeve and the lower handle portion of said handle simultaneously with at least one hand; and depressing said lower handle portion towards said container and/or said sleeve until said one or more radially inwardly extending lugs disengages said sleeve's edge undercut.

28. The method of claim 27, wherein said handle must be moved in at least two directions to remove the cap portion from the sleeve.

29. The method of claim 27, further comprising resealing the container with the cap portion by engaging said one or more radially inwardly extending lugs with said sleeve's edge undercut.

30. The method of claim 27, wherein said container and/or sleeve and the lower handle portion of said handle are simultaneously held with only one hand when removing or securing the cap portion to the sleeve.

* * * * *